US005133191A

United States Patent [19]

Bruhn et al.

[11] Patent Number: 5,133,191

[45] Date of Patent: Jul. 28, 1992

[54] HIGH TEMPERATURE COGENERATION AND HEAT RECOVERY PROCESS

[75] Inventors: Alfred A. Bruhn, Eastchester, N.Y.; Gregory P. Schneck, Pottstown, Pa.

[73] Assignee: American Hydrotherm Corporation, New York, N.Y.

[21] Appl. No.: 647,256

[22] Filed: Jan. 29, 1991

[51] Int. Cl.[5] ..... F01K 3/00

[52] U.S. Cl. ..... 60/659

[58] Field of Search ..... 60/659

[56] References Cited

U.S. PATENT DOCUMENTS

| | | | |
|---|---|---|---|
| 2,820,348 | 1/1958 | Sauter | 60/659 |
| 3,974,642 | 8/1976 | Pacault | 60/659 X |
| 4,257,579 | 3/1981 | Bruhn . | |
| 4,340,207 | 7/1982 | Bruhn et al. . | |
| 4,844,020 | 7/1989 | Bruhn . | |
| 5,033,414 | 7/1991 | Bruhn . | |

*Primary Examiner*—Allen M. Ostrager

*Attorney, Agent, or Firm*—Fleit, Jacobson, Cohn, Price, Holman & Stern

[57] ABSTRACT

A heat recovery system includes a storage tank for an intermediate heat transfer fluid and a heat exchanger for receiving an intermittent flow of heated stack gas from a reheat furnace, whereby heating values from the stack gas are transferred to the heat transfer fluid. The system includes a steam generator and the heating values acquired by the heat transfer fluid are used to generate and to superheat the steam. The heat transfer medium is controlled so that the flow of superheated steam produced is substantially steady. The heated stack gas may be used to preheat boiler feed water used for steam generation. The processes used are also described.

5 Claims, 2 Drawing Sheets

HIGH TEMPERATURE COGENERATION AND HEAT RECOVERY PROCESS

FIELD OF THE INVENTION

The invention relates to heat exchange processes and waste heat recovery, in particular, to a process and apparatus for the recovery of heat from high temperature gases.

BACKGROUND OF THE INVENTION

U.S. Pat. Nos. 4,257,579 and 4,340,207 describe a heat recovery process and apparatus for recovering heat from waste gases having a temperature of about 500° F. to about 2500° F., when the flow of hot gas is intermittent. Heat transfer salt and/or heat transfer oil provides thermal storage. The stored heat is evenly transferred to other steady processes such as preheating air, generating steam for process use or driving a steam turbine or for process heating.

Steel mill reheat furnaces often use combustion air in waste gas recuperators to attempt to recover the heat from the waste gas. These recuperators are inefficient, and subject to equipment failures. In a typical design, the recuperator should cool the hot gas from 1730° F. to 965° F. by heating air from 70° F. to 1015° F. The actual performance typically cools the hot gas from 1200° F. to 1000° F. by heating air from 70° F. to 688° F. The recuperators are inefficient because they recover less than 50% of the available heat. Moreover, the recuperators are subject to equipment failure because of the high metal temperatures (1300° F. to 1500° F.) and frequent wide swings in temperature (normally 1000° F. to 1800° F. and sometimes 60° F. to 2000° F.).

SUMMARY OF THE INVENTION

A heat recovery system includes a storage tank for an intermediate heat transfer fluid and a heat exchanger for receiving an intermittent flow of heated stack gas from a reheat furnace, whereby heating values from the stack gas are transferred to the heat transfer fluid. The system includes a steam generator and the heating values acquired by the heat transfer fluid are used to generate and to superheat the steam. The heat transfer medium is controlled so that the flow of superheated steam produced is substantially steady. The heated stack gas may be used to preheat boiler feed water used for steam generation. The processes used are also described.

It is an object of the invention to provide a high temperature cogeneration and heat recovery process utilizing heat transfer salt and/or heat transfer oil to recover the sensible heat leaving a furnace, such as a steel mill reheat furnace.

DETAILED DESCRIPTION OF THE INVENTION

This invention relates to heat recovery processes, such as are described in U.S. Pat. Nos. 4,257,579, 4,340,207 and 4,844,020 and in Ser. No. 339,130, filed Apr. 14, 1989, now U.S. Pat. No. 5,033,414, the disclosures of which are incorporated herein by reference.

The heat exchange system used in the high temperature cogeneration and heat recovery process of the invention uses an intermediate heat transfer fluid which is a liquid at the operational temperature. Suitable heat transfer fluids are, for non limiting examples, eutectic salt systems, heat transfer oils or water. An advantage of using the inventive system is that the heat exchange unit may be fabricated using conventional materials in contrast to more expensive, high alloy materials needed to withstand high metal temperatures.

The system may be used for a process operation cycling between an operational mode and an idling mode, such as the operation of a steel mill reheat furnace in which there is produced an exhaust or waste gas at temperatures of from about 500° F. to about 2000° F. A reheat furnace typically cycles about 4–8 times an hour, generating an intermittent flow of waste stack gas. An important feature of the present invention is the ability to store heat in the heat transfer fluid system when the furnace is cycling and to reject heat when the system is idling. Advantages of the heat recovery system described are found in U.S. Pat. No. 4,340,207, in addition to the other patents, mentioned above, having disclosures incorporated herein by reference.

The intermittent flow of stack gas from a reheat furnace, at elevated temperature, is passed to the outside of tubes in a heat exchanger. The temperature of heat transfer medium in the heat exchange tubes is increased from about 580° F. to about 680° F. by acquisition of heating values from the stack gas. The heating values acquired by the heat transfer medium provide heat for generating and superheating high pressure steam. The thus cooled heat transfer medium passes to a thermal storage tank of sufficient size to keep the temperature of the heat transfer medium sufficiently constant to provide a steady flow of steam.

In operation, the flow of heat transfer medium to the steam generator is controlled to provide a steady flow of steam. As the steam flow increases, more of the heat transfer medium bypasses the steam generator and the temperature of the heat transfer medium gradually rises.

The stack gas which has already given up a portion of its heating values to the heat transfer medium may be further cooled by using it for preheating the boiler feed water before the water goes to the steam generator.

The reheat furnace is supplied with hot combustion air from the outlet of a gas turbine and the reheat furnace waste gas passes to the heat recovery system with thermal storage. The hot combustion air from the gas turbine has an oxygen content of about 16%, which is sufficient for combustion of fuel in the reheat furnace.

Figure 1:
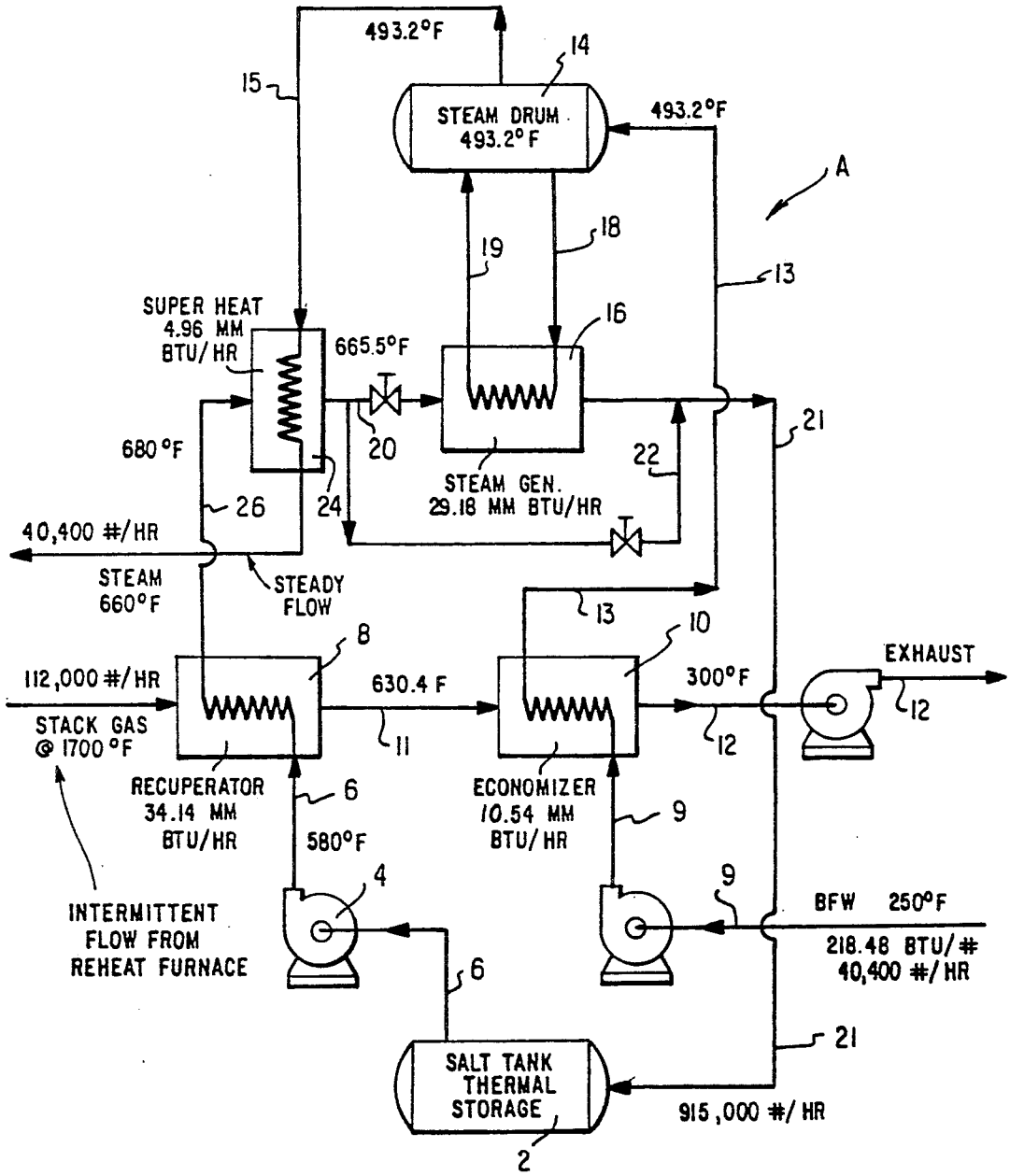
FIG. 1 is a schematic flow sheet of a heat recovery process of the invention.

With reference to the figures, in which like numerals represent like parts, FIG. 1 shows a flow sheet and apparatus A for a heat recovery and thermal storage process of the invention. Heat transfer medium, such as heat transfer salt or heat transfer oil, is stored in a thermal storage tank 2. In a typical example, the heat transfer medium is pumped by pump 4 through lines 6 to a heat exchanger 8 at a temperature of about 580° F. Hot stack gas from a reheat furnace (not shown), at a temperature of about 1700° F. intermittently flows around the outside of the tubes containing the heat transfer medium in heat exchanger 8. The stack gas leaving the heat exchanger has a temperature of about 630° F. The stack gas gives up heat to the heat transfer medium which leaves the heat exchanger, through line 26, having a temperature of about 680° F.

Boiler feed water at a temperature of, for example, about 250° F. enters the system and is pumped through an economizer 10 where it is heated by the stack gas leaving heat exchanger 8. Stack gas enters the economizer through line 11, at about 630° F., and leaves the economizer through line 12, at a temperature of about 300° F., and is exhausted to the atmosphere. The boiler feed water gains heat from the stack gas and leaves the economizer at a temperature of about 493° F. through lines 13 and enters steam drum 14, as shown.

Steam generator 16 operates by natural circulation of water passing through line 18 from steam drum 14 to steam generator 16 and circulation of steam and water passing from steam generator 16 to steam drum 14 through line 19. Steam generator 16 is controlled to hold a steady flow of steam by controlling the flow of heat transfer medium through the steam generator. Heat transfer medium flows through line 20 through the steam generator to generate steam and through line 22 to bypass the steam generator. By controlling the flow of heat transfer medium, the steam generator is controlled to provide a steady flow of steam. Steam passes from steam drum 14 through line 15, at about 493° F., through superheater 24. Superheater 24 is heated by heat transfer medium flowing through line 26 at a temperature of about 680° F. The heat transfer medium gives up its heat to superheat the steam and the heat transfer medium leaves the superheater through line 20 at a temperature of about 665° F. The temperature of the steam as it passes through the superheater is raised to about 660° F. and a steady flow of steam of about 40,400 pph leaves the apparatus. Heat transfer medium is recycled from steam generator 16 to thermal storage tank 2 through line 21.

The intermittent flow of stack gas from the reheat furnace is used ultimately to provide a steady flow of steam at about 660° F. by controlling the amount of thermal transfer medium used to generate steam in steam generator 16. The thermal transfer medium either passes through steam generator 16 or bypasses the steam generator, as necessary.

The heat transfer medium gains heat from the exhaust stack gas, such as stack gas from a steel mill reheat furnace, and gives up a portion of the heat gained for steam generation. A further portion of the stack gas heat is given up to heat the boiler feed water before the stack gas is exhausted to the atmosphere. The preliminarily heated boiler feed water gains further heat from the heat transfer medium which passes inside or outside of tubes in a steam generator.

Figure 2:
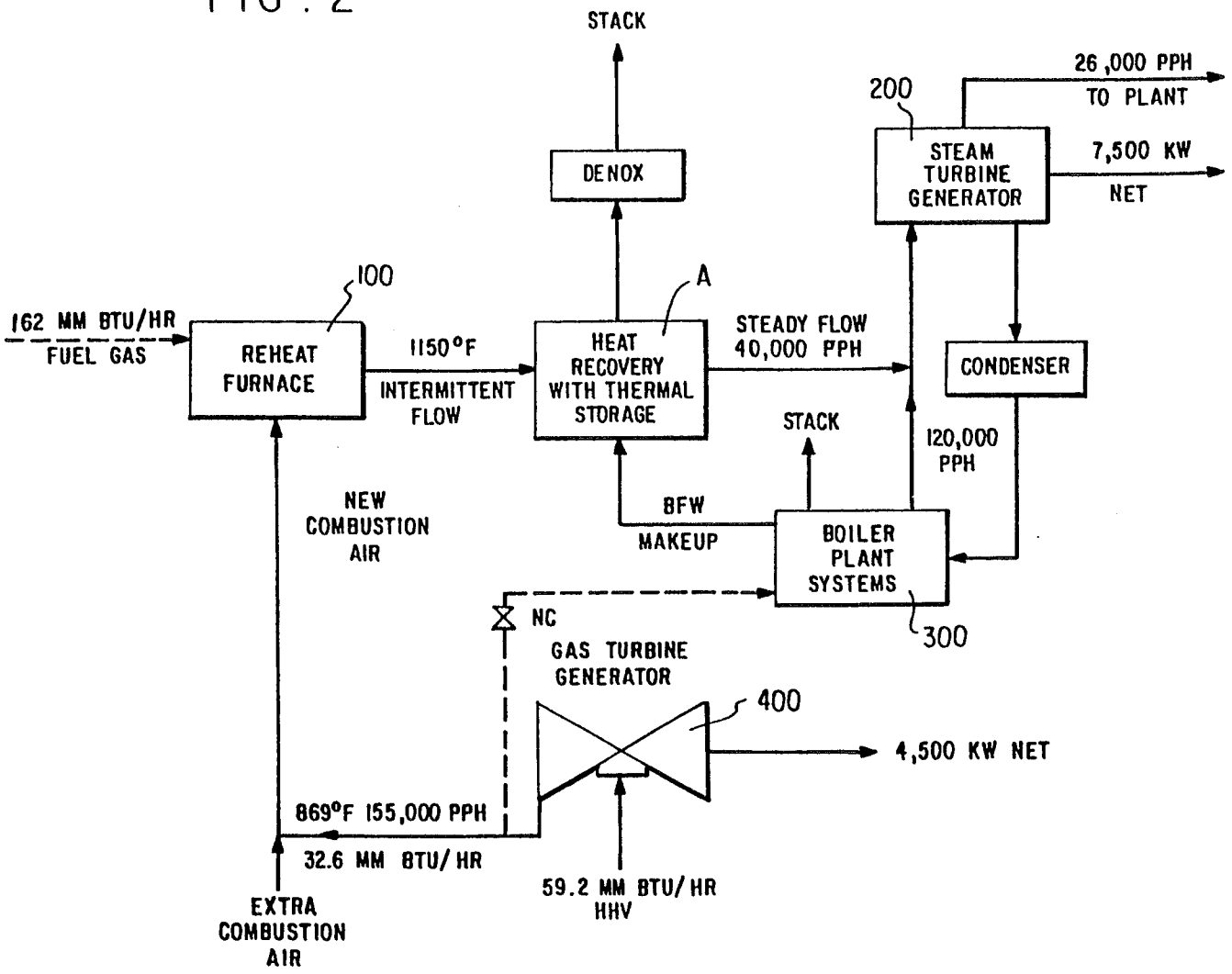
FIG. 2 is a process flow sheet of a cogeneration plant.

FIG. 2 illustrates the use of the heat recovery system A, shown in FIG. 1, as a steam generator for feeding a steam turbine in a cogeneration plant. In a typical example, shown in FIG. 2, reheat furnace 100 provides an intermittent flow of waste stack gas at about 1150° F. to heat recovery plant A which includes thermal storage, as shown in FIG. 1 and described above. Heat recovery plant A produces a steady flow of steam, such as 40,000 pph, which is fed to a steam turbine generator 200. Steam is also provided to steam turbine generator 200 from boiler plant 300 which provides boiler feed water to heat recovery plant A. Hot gas having about 16% oxygen content, exhausted from gas turbine generator 400, may optionally feed reheat furnace 100.

While the invention has been described with respect to certain embodiments thereof, it will be appreciated that variations and modifications may be made without departing from the spirit and scope of the invention. In particular the temperatures and quantities described are non-limiting examples.

What is claimed is:

1. A heat recovery system comprising:

a storage tank for an intermediate heat transfer fluid;

heat exchanger means for receiving an intermittent flow of heated stack gas from a reheat furnace and for receiving a supply of said intermediate heat transfer fluid from said storage tank in heat exchange relationship with said stack gas, whereby heating values from said stack gas are transferred to heat said heat transfer fluid;

means for generating steam comprising heat exchange means for receiving boiler feed water and for receiving said heated heat transfer fluid in heat exchange relationship with said boiler feed water, whereby heating values from said heated heat transfer fluid are transferred to said boiler feed water to generate steam;

means for controlling flow of said heat transfer fluid to hold flow of said steam substantially steady;

wherein said stack gas is further cooled by transferring heating values therefrom to raise the temperature of said feed water, said feed water subsequently being passed to said means for generating steam.

2. A process for recovering heating values from hot stack gas comprising:

passing thermal transfer fluid from a storage tank through a heat exchanger;

passing hot stack gas through the heat exchanger in heat exchange relationship with said thermal transfer fluid, whereby said thermal transfer fluid acquires heating values from said hot stack gas;

transferring further heating values from said stack gas to heat feed water;

subsequently using heating values acquired from the stack gas by the thermal transfer fluid and the feed water for generating a substantially steady flow of steam.

3. A process according to claim 2 further comprising enabling at least a part of the thermal transfer fluid to bypass the steam generating step.

4. A process according to claim 2 wherein the hot stack gas is received from a reheat furnace and the process further comprises supplying the reheat furnace with hot combustion air from the outlet of a gas turbine.

5. A process according to claim 4 comprising supplying the reheat furnace with hot combustion air having an oxygen content of about 16% for supporting fuel combustion in the reheat furnace.

* * * * *